US007922408B2

(12) United States Patent
Daisuke

(10) Patent No.: US 7,922,408 B2
(45) Date of Patent: Apr. 12, 2011

(54) PRINTER WITH BELT TENSIONING UNIT

(75) Inventor: Okamoto Daisuke, Tokyo (JP)

(73) Assignees: Kabushiki Kaisha Sato (JP); Sato Knowledge and Intellectual Property Institute (JP)

( * ) Notice: Subject to any disclaimer, the term of this patent is extended or adjusted under 35 U.S.C. 154(b) by 582 days.

(21) Appl. No.: 11/939,887

(22) Filed: Nov. 14, 2007

(65) Prior Publication Data

US 2008/0193184 A1 Aug. 14, 2008

(30) Foreign Application Priority Data

Feb. 9, 2007 (JP) ..... 2007-030697

(51) Int. Cl.
*B41J 17/08* (2006.01)

(52) U.S. Cl. ..... 400/236; 400/223; 347/215

(58) Field of Classification Search ..... 400/223, 400/234, 236; 347/215
See application file for complete search history.

(56) References Cited

U.S. PATENT DOCUMENTS

| | | | | |
|---|---|---|---|---|
| 4,577,199 | A * | 3/1986 | Saiki et al. | 347/215 |
| 4,812,063 | A * | 3/1989 | Kunimitsu et al. | 400/234 |
| 5,718,525 | A * | 2/1998 | Bruhnke et al. | 400/586 |

FOREIGN PATENT DOCUMENTS

| | | | |
|---|---|---|---|
| EP | 1226950 | A1 * | 7/2002 |
| JP | 58-101757 | | 7/1983 |
| JP | 62212179 | A * | 9/1987 |
| JP | 9-324849 | | 12/1997 |
| JP | 2002-200809 | | 7/2002 |
| JP | 2004299283 | A * | 10/2004 |

* cited by examiner

*Primary Examiner* — Daniel J Colilla

(74) *Attorney, Agent, or Firm* — Ostrolenk Faber LLP

(57) ABSTRACT

A thermal transfer printer having a configuration in which a drive power of one motor is transmitted to a platen roller and a ribbon conveying mechanism can be easily assembled. The printer has: (a) a printing medium feed reel, (b) a ribbon feed reel, (c) a platen roller, (d) a thermal head, (e) a ribbon conveying roller, (f) a ribbon take-up reel, (g) a motor that drives the platen roller, (h) a rotary drive mechanism that transmits a drive power of the motor to the ribbon conveying roller via a first belt and transmits a drive power of the motor to the ribbon take-up reel via the first belt and a second belt, and (i) a tension unit comprising a plurality of pulleys that are in contact with the first and second belts and rotate following the movement thereof, a plurality of elastic members that adjust positions of the plurality of pulleys so as to apply tension to the first and second belts, and a plurality of fixing members that fix the positions of the plurality of pulleys.

3 Claims, 3 Drawing Sheets

(a)

(b)

PRINTER WITH BELT TENSIONING UNIT

BACKGROUND OF THE INVENTION

1. Field of the Invention

The present invention relates to a printer that performs printing by transferring ink of an ink ribbon onto a printing medium by using a thermal head.

2. Description of the Related Art

Thermal transfer printers in which printing is performed by transferring ink of an ink ribbon onto a printing medium by using a thermal head have been used as printers for printing on printing media such as labels attached to a mounting paper and band-shaped sheets for tag fabrication. In thermal transfer printers, the printing is performed by transferring ink of an ink ribbon onto a printing medium by heat generated by a heat-generating body of a thermal head, while intermittently conveying the printing medium and the ink ribbon in the same direction and at the same speed.

Accordingly, a thermal transfer printer is provided with a platen roller that conveys the printing medium and ink ribbon and also with a ribbon conveying mechanism that is composed of a ribbon feed reel, a ribbon conveying roller, and a ribbon take-up reel. However, if the platen roller and the ribbon conveying mechanism are driven with separate motors, the motors are difficult to control and the cost rises. Therefore, a configuration can be considered in which the drive power of one motor is transmitted to both the platen roller and the ribbon conveying mechanism by using a timing belt and gears.

In belt drive mechanisms in which a drive power of a drive pulley is transmitted to a driven pulley via a timing belt, an idle pulley for adjusting the tension of the timing belt is disposed between the drive pulley and driven pulley, and if a belt drive mechanism of a multistage system is used, the number of idle pulleys has to be equal to the number of timing belts. As a result, the number of parts is increased, a space is required for disposing the parts, and the belt drive mechanism is difficult to assembly. Furthermore, the tension of the timing belt has to be measured by using an adjustment tool such as a push gage in order to adjust and verify the tension of the timing belt.

As a pertinent technology, Japanese Patent Application Laid-open No. 2002-200809 (page 1, FIG. 1) discloses a printer having a timing belt that transmits a drive power from a drive source (pulse motor) to a platen roller and a conveying roller, and a first tension member (tension roller) and a second tension member (tension pulley) that apply tension to the timing belt, this printer comprising a rotary member that rotatably holds any one tension member. With such a structure an error in tension occurring when only one tension member (tension roller) is used to rotate two rollers by a drive power of one motor can be eliminated and uniform tension can be obtained along the entire circumference of the timing melt. However, a space is required to arrange the two tension members, and the printer is difficult to assembly.

SUMMARY OF THE INVENTION

The present invention was created with the foregoing in view. It is an object of the present invention to save space and facilitate the assembly of a printer that performs printing by transferring ink of an ink ribbon onto a printing medium by using a thermal head, while employing a configuration that transfers a drive power of one motor to a platen roller and a ribbon conveying mechanism.

To attain the above-described object, the present invention in one gist thereof provides a printer comprising: (a) a printing medium feed reel that feeds a printing medium, (b) a ribbon feed reel that feeds an ink ribbon, (c) a platen roller that conveys the printing medium that is fed from the printing medium feed reel and the ink ribbon that is fed from the ribbon feed reel, (d) a thermal head that is disposed opposite the platen roller via the printing medium and the ink ribbon and performs printing by transferring ink of the ink ribbon onto the printing medium, (e) a ribbon conveying roller for conveying the ink ribbon that has been used for printing, (f) a ribbon take-up reel that takes up the ink ribbon that is conveyed by the ribbon conveying roller, (g) a motor that drives the platen roller, (h) a rotary drive mechanism that transmits a drive power of the motor to the ribbon conveying roller via at least a first belt and transmits a drive power of the motor to the ribbon take-up reel via at least the first belt and a second belt, and (i) a tension unit comprising a plurality of pulleys that are in contact at least with the first belt and second belt and rotate following the movement thereof, a plurality of elastic members that adjust positions of the plurality of pulleys so as to apply tension at least to the first belt and second belt and a plurality of fixing members that fix the positions of the plurality of pulleys.

In accordance with the present invention, by using the tension unit that can adjust the tension applied at least to the first belt and the second belt that transmit the drive power of the motor to the ribbon conveying roller and the ribbon take-up reel, the space can be saved and printer assembling can be facilitated.

DESCRIPTION OF THE PREFERRED EMBODIMENTS

Figure 1:
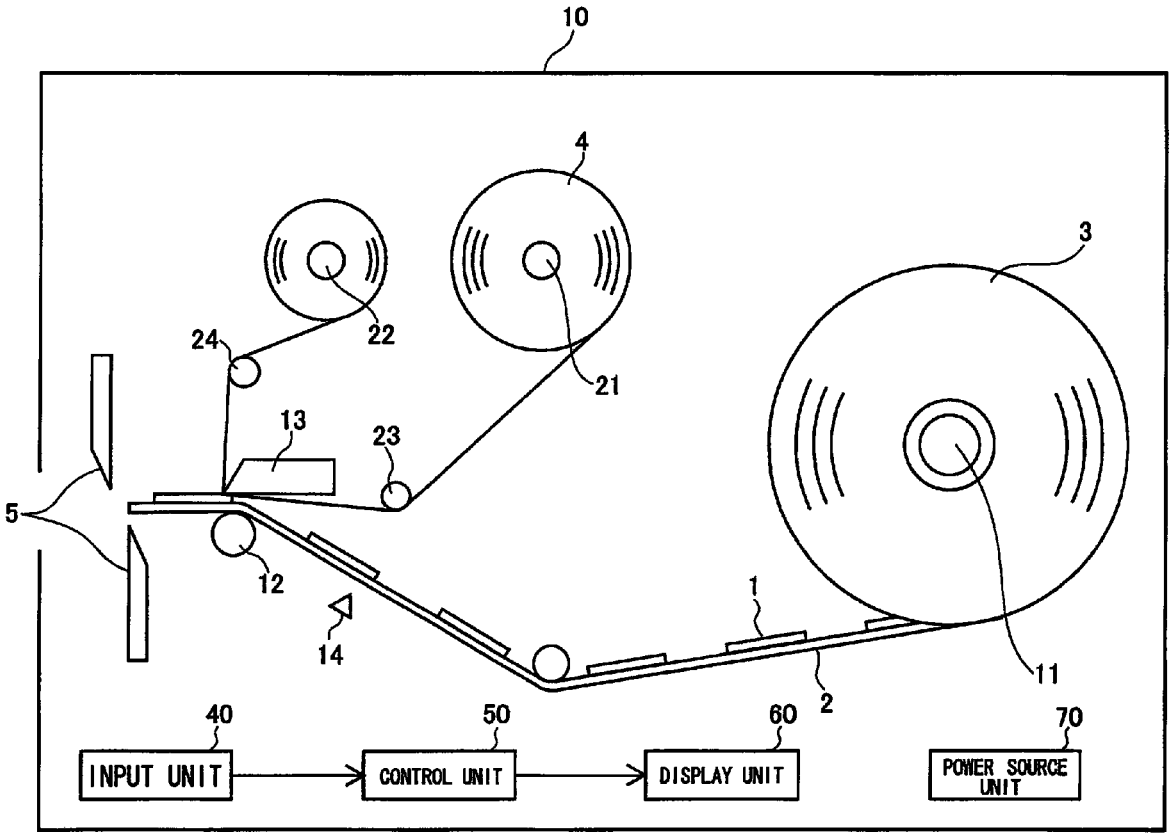
FIG. 1 is a schematic drawing illustrating the structure at the right side surface of the printer of one embodiment of the present embodiment.

The best mode for carrying out the present invention will be described below in greater detail with reference to the appended drawings. Identical structural elements will be assigned with identical reference numerals and explanation thereof will be omitted.

FIG. 1 is a schematic drawing illustrating the structure at the right side surface of the printer of one embodiment of the present embodiment. This printer performs printing on printing media such as labels attached to a mounting paper and band-shaped sheets for tag fabrication, and the printing is carried out by transferring ink of an ink ribbon onto the printing medium by using a thermal head. The explanation below relates to an example in which printing is performed on the labels attached to a mounting paper.

As shown in FIG. 1, inside a printer casing 10, a continuous body 3 of labels in which labels 1 are peelably attached to a mounting paper 2 is wound in a roll and held rotatably on a label feed reel 11.

On the other hand, an ink ribbon 4 is wound on a ribbon feed reel 21 and a ribbon take-up reel 22. A guide pole 23 and a ribbon conveying roller 24 are provided to establish the conveying route of the ink ribbon 4. The ribbon conveying roller 24 and the ribbon take-up reel 22 are driven and rotated with the stepping motor.

A platen roller 12 is driven and rotated by the stepping motor. As a result, the continuous body 3 of labels and the ink ribbon 4 are intermittently conveyed in the same direction and at the same speed. The mechanism for rotary driving the platen roller 12, ribbon conveying roller 24, and ribbon take-up reel 22 with the stepping motor will be referred to hereinbelow as "rotary drive mechanism".

A thermal head 13 has an assembly of a plurality of fine heat-generating bodies that generate heat when an electric current is passed therethrough. The thermal head is disposed opposite the platen roller 12 via the continuous body 3 of labels and the ink ribbon 4. Printing is performed by applying a voltage and passing an electric current through these heat-generating bodies, thereby causing the heat-generating bodies to generate heat, and transferring the ink of the ink ribbon 4 onto the label 1.

An input unit 40 includes a keyboard and is used to operate the printer. A control unit 50 comprises, for example, a CPU and software and controls the operation of each unit. A display unit 60 comprises an LCD panel for displaying an error message or the like and performs a variety of displays based on signals supplied from the control unit 50. A power source unit 70 supplies power to each unit.

The printing operation of the printer shown in FIG. 1 will be described below. When the stepping motor rotates the platen roller 12 in a state in which the continuous body 3 of labels and the ink ribbon 4 are inserted between the platen roller 12 and the thermal head 13, the continuous body 3 of labels and the ink ribbon 4 are intermittently conveyed from right to left, as shown in the figure. The operation of conveying the continuous body 3 of labels and the ink ribbon 4 is controlled by the control unit 50 based on the detection results of a label sensor 14.

By supplying printing signals to the thermal head 13, while thus intermittently conveying the continuous body 3 of labels and the ink ribbon 4, the heat-generating bodies of the thermal head 13 are caused to generate heat, and printing is performed on the label 1. The label 1 on which printing has been performed is discharged to the outside from a label discharge port. The mounting paper 2 to which individual labels 1 have been attached may be separated by providing a cutter 5 in the vicinity of the label discharge port and cutting the mounting paper 2 with the cutter 5. The ink ribbon used for printing is conveyed with the ribbon conveying roller 24 and taken up on a ribbon take-up reel 22.

Figure 2:
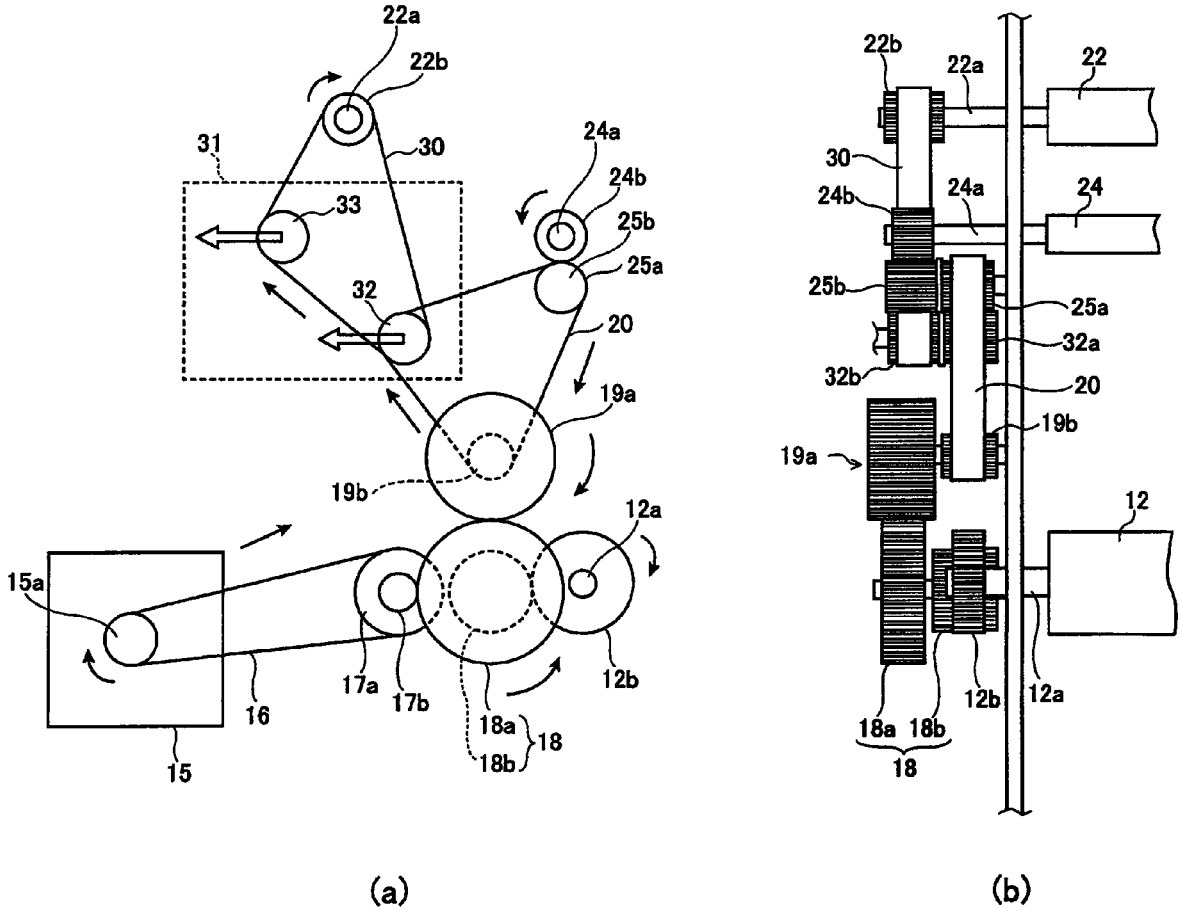
FIG. 2 is a schematic drawing illustrating a rotary drive mechanism and a tension unit of the printer of one embodiment of the present invention.

FIG. 2 is a schematic drawing illustrating a rotary drive mechanism and a tension unit of the printer of one embodiment of the present invention. FIG. 2A is a side view illustrating the left side surface of the printer. FIG. 2B is a front view illustrating the label discharge side of the printer. The tension unit 31, which represents a specific feature of the present embodiment, has a double pulley 32 and a tension pulley 33 that are disposed in contact with timing belts 20 and 30, respectively, and rotated by following the movement thereof. These pulleys 32 and 33 are biased in the direction shown by an arrow in FIG. 2. Some members in FIG. 2B are omitted.

As shown in FIG. 2, a stepping motor 15 rotates a motor shaft 15*a*, thereby driving the pulley 17*a* via the timing belt 16. Teeth are formed on the inner circumference of the timing belt 16, and teeth are formed on the outer circumference of the pulley 17*a* for engagement with the teeth of the timing belt 16. The same is true for the timing belts and pulleys described hereinbelow.

A gear 17*b* is mounted on a shaft of the pulley 17*a* and the two rotate together. The gear 17*b* drives a first gear 18*a* of a double gear 18. The double gear 18 has the first gear 18*a* and a second gear 18*b* and the two rotate together. The second gear 18*b* of the double gear 18 drives a gear 12*b* mounted on a platen roller shaft 12*a*. As a result, a drive power of the stepping motor 15 is transmitted to the platen roller 12 shaft 12*a* via the pulley 17*a*, gear 17*b*, and double gear 18.

The first gear 18*a* of the double gear 18 drives a gear 19*a*. A pulley 19*b* is mounted on a shaft of the gear 19*a* and the two rotate together. The pulley 19*b* rotates a pulley 25*a* and a first pulley 32*a* of a double pulley 32 via a timing belt 20. The double pulley 32 has the first pulley 32*a* and a second pulley 32*b* and the two rotate together.

A gear 25*b* is mounted on a shaft of the pulley 25*a* and the two rotate together. The gear 25*b* drives a gear 24*b* mounted on a ribbon conveying roller shaft 24*a*.

As a result, a drive power of the stepping motor 15 is transmitted to the ribbon conveying roller shaft 24*a* via the pulley 17*a*, gear 17*b*, double gear 18, gear 19*a*, pulley 19*b*, pulley 25*a* and gear 25*b*, whereby the ribbon conveying roller 24 is rotated.

Moreover, the second pulley 32*b* of the double pulley 32 drives a pulley 22*b* mounted on a ribbon take-up reel shaft 22*a* via the timing belt 30. As a result, a drive power of the stepping motor 15 is transmitted to the ribbon take-up reel shaft 22*a* via the pulley 17*a*, gear 17*b*, double gear 18, gear 19*a*, pulley 19*b*, and double pulley 32, whereby the ribbon take-up reel 22 is rotated. The ribbon take-up reel 22 can slide with respect to the ribbon take-up reel shaft 22*a*, and the ribbon tension does not rise above a set value, for example, even when the transportation of the ribbon is stopped.

Here, the double pulley 32 of the tension unit 31 applies tension to the timing belt 20, and the tension pulley 33 applies tension to the timing belt 30.

Figure 3:
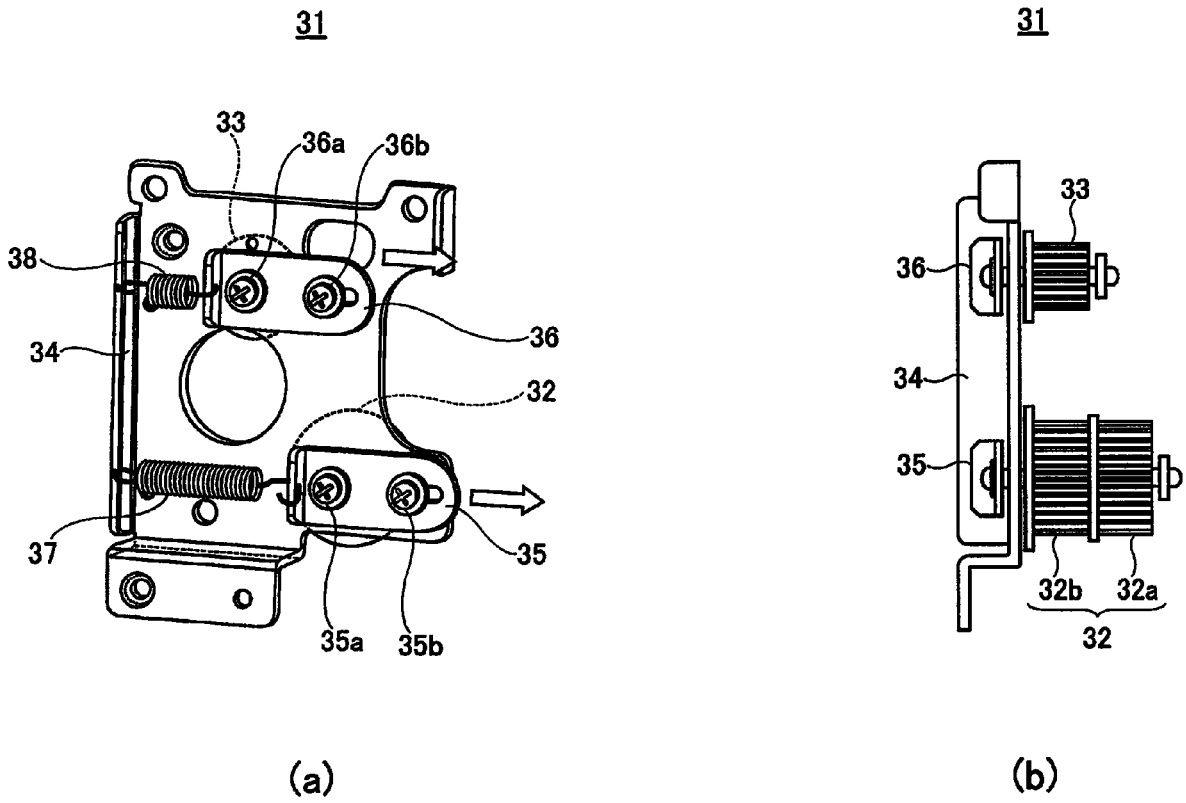
FIG. 3 shows a detailed structure of the tension unit.

FIG. 3 shows a detailed structure of the tension unit. FIG. 3A is a perspective view, and FIG. 3B is a plan view (label discharge side). As shown in FIG. 3, the tension unit 31 comprises a base material 34, a double pulley support body 35 and a tension pulley support body 36 that are slidably mounted on the base material 34, coil springs 37 and 38 serving as elastic members for biasing the support bodies 35 and 36 in a predetermined direction (to the left, as shown in the figure), the double pulley 32 that is rotatably supported by the double pulley support body 35 by using a screw 35*a*, the tension pulley 33 that is rotatably supported by the tension pulley support body 36 by using a screw 36*a* as well as screws 35*b* and 36*b* serving as fixing members for fixing the support bodies 35 and 36 to the base material 34.

The screw 35*a* rotatably supports the double pulley 32 via a round hole provided in the double pulley support body 35 and an elongated hole provided in the base material 34. The screw 35*b* is attached to the base material 34 via an elongated hole provided in the double pulley support body 35. When the screw 35*b* is loosened, the double pulley support body 35 and the double pulley 32 can slide with respect to the base material 34 and are biased by the coil spring 37 to the left as shown in the figure.

The screw 36*a* rotatably supports the tension pulley 33 via a round hole provided in the tension pulley support body 36 and an elongated hole provided in the base material 34. The screw 36*b* is attached to the base material 34 via an elongated hole provided in the tension pulley support body 36. When the screw 36*b* is loosened, the tension pulley support body 36 and the tension pulley 33 can slide with respect to the base mate rial 34 and are biased by the coil spring 38 to the left as shown in the figure.

The screws 35*b* and 36*b* are used to fix the positions of the double pulley 32 and tension pulley 33, respectively. When the rotary drive mechanism is assembled, an operator moves the double pulley support body 35 and the tension pulley support body 36 in the direction shown by an arrow in FIG. 3A (to the left) and then tightens the screws 35*b* and 36*b*. As a result, the operation of stretching the tension belts 20 and 30 (FIG. 2) over the pulleys is facilitated.

After the rotary drive mechanism is assembled, the operator first loosens the screw 35*b*, and the double pulley 32 is moved to a position in which an appropriate tension is applied to the tension belt 20 (FIG. 2) by the contraction force of the coil spring 37. The position of the double pulley 32 is thereby automatically adjusted. Then, the operator tightens the screw 35*b*, whereby the double pulley 32 is fixed in an adequate position.

The operator then loosens the screw 36*b*, and the tension pulley 33 is moved to a position in which an appropriate tension is applied to the tension belt 30 (FIG. 2) by the contraction force of the coil spring 38. The position of the tension pulley 33 is thereby automatically adjusted. Then, the operator tightens the screw 36*b*, whereby the tension pulley 33 is fixed in an adequate position. With such a tension unit 31, the rotary drive mechanism can be assembled or readjusted so that an adequate tension is applied to the tension belt, without using an adjustment tool.

The explanation hereinabove was conduced with respect to a two-stage belt tension mechanism for applying an adequate tension to two tension belts 20 and 30 shown in FIG. 2, but the present invention is not limited to such a mechanism and a belt tension mechanism composing three or more stages can be also configured when three or more tension belts are used in the rotary drive mechanism. In this case, the number of pulleys and pulley support bodies may be set equal to the number of tension belts that apply tension.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A printer comprising:

a printing medium feed reel that feeds a printing medium;

a ribbon feed reel that feeds an ink ribbon;

a platen roller that conveys the printing medium that is fed from said printing medium feed reel and the ink ribbon that is fed from said ribbon feed reel;

a thermal head that is disposed opposite said platen roller via the printing medium and the ink ribbon and performs printing by transferring ink of the ink ribbon onto the printing medium;

a ribbon conveying roller for conveying the ink ribbon that has been used for printing;

a ribbon take-up reel that takes up the ink ribbon that is conveyed by said ribbon conveying roller;

a motor that drives said platen roller;

a rotary drive mechanism that transmits a drive power of said motor to said ribbon conveying roller via at least a first belt and transmits a drive power of said motor to said ribbon take-up reel via at least the first belt and a second belt; and a tension unit comprising a plurality of pulleys that are in contact at least with said first belt and second belt and rotate following the movement thereof, a plurality of elastic members that adjust positions of said plurality of pulleys so as to apply tension at least to said first belt and second belt and a plurality of fixing members that fix the positions of said plurality of pulleys.

2. The printer according to claim 1, wherein said plurality of pulleys comprise: a first pulley that is in contact with said first belt, rotates following the movement thereof, and transmits the drive power transmitted from said first belt to said second belt; and a second pulley that is in contact with said second belt and rotates following the movement thereof.

3. The printer according to claim 1, wherein said tension unit further comprises a base material and a plurality of support members that are slidably attached to said base material and rotatably support said plurality of pulleys; said plurality of elastic members comprise a plurality of coil springs that bias said plurality of support members in a predetermined direction; and said plurality of fixing members comprise a plurality of screws for fixing said plurality of support members to said base material.

* * * * *